United States Patent [19]

McKenzie

[11] 3,958,789

[45] May 25, 1976

[54] BRICK HANGER

[76] Inventor: Leo A. McKenzie, 3540 Ridgeway Drive, Bethel Park, Pa. 15102

[22] Filed: Jan. 9, 1975

[21] Appl. No.: 539,629

[52] U.S. Cl. ..... 248/340; 52/715; 110/99 R

[51] Int. Cl.[2] ..... E06B 3/64; E04B 5/52

[58] Field of Search ..... 248/317, 340, 301; 52/715, 484; 110/99 R

[56] References Cited

UNITED STATES PATENTS

| | | | |
|---|---|---|---|
| 1,864,965 | 6/1932 | Venzie | 52/484 X |
| 2,129,975 | 9/1938 | Urbain | 52/484 X |
| 2,742,023 | 4/1956 | Rentjes | 110/99 R X |
| 2,754,093 | 7/1956 | Wennerberg | 248/340 X |
| 3,400,672 | 9/1968 | Dickson | 110/99 R |
| 3,561,718 | 2/1971 | Iverson | 248/340 |

*Primary Examiner*—J. Franklin Foss
*Attorney, Agent, or Firm*—William J. Ruano

[57] ABSTRACT

A hanger for supporting, on a rod, a plurality of bricks or the like in overhead arches, spans and similar structures. The hanger has an open ended portion or hook for support on the rod and to allow lateral insertion or withdrawal from the rod to avoid the necessity of lifting an entire assembly of bricks while supported on the rod for mortaring an overhead arch or similar structure. Lateral toothed portions are provided for supporting the bricks or for projecting into the sidewalls of frangible building units.

1 Claim, 3 Drawing Figures

BRICK HANGER

This invention relates to a hanger or support for holding bricks and similar structural units for bricking arches and similar spans or ceiling portions when erecting a building or other structure.

An outstanding disadvantage of conventional hangers is that a hole is provided in the top portion for sliding along the supporting rod, which rod is lifted into place together with all the supported bricks just before the bricks are to be mortared into the overhead span. Because of such structure, it is often time necessary to lift a very heavy load of bricks, particularly for large spans, which is a very difficult and laborious task for the bricklayer, particularly in high elevations.

Also, such commonly used hangers do not have any simple means for supporting a large number of bricks, moreover, they are relatively complicated in construction and expensive to manufacture.

An object of my invention is to provide a novel hanger for bricks which will overcome the abovementioned disadvantages of conventional hangers and which permits the hanger to be easily and quickly attached to or withdrawn from the supporting rod.

A further object of my invention is to provide a novel hanger for bricks which is provided with simple laterally extending toothed elements for supporting bricks by providing ledges on both sides of the element, which may also be projected into the sidewalls of certain types of frangible structural elements just before mortaring overhead spans of bricks of structural elements.

Other objects and advantages will become more apparent from a study of the following description taken with the accompanying drawing wherein.

Figure 2:
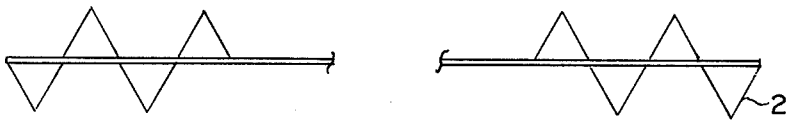
FIG. 2 is a fragmentary top view thereof as viewed in the direction of the arrows 2—2; and, FIG. 3 is a side view thereof as viewed from the right of FIG. 1.
Figure 1:
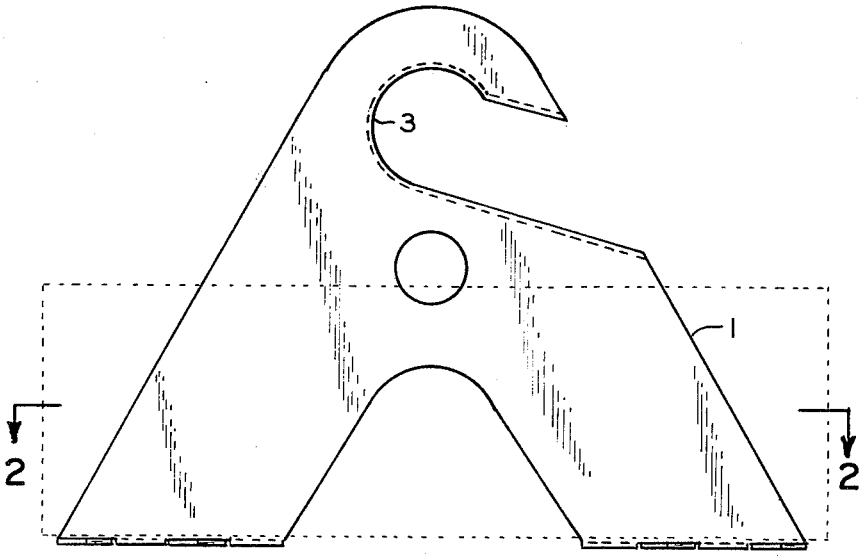
FIG. 1 is a front elevational view of a hanger for bricks, which hanger embodies the principles of the present invention.

Referring more particularly to the drawing, numeral 1 generally denotes a hanger of the present invention which may be made of steel, aluminum or other suitable material and which has, at the bottom ends of a pair of leg portions, integral lateral extending toothed elements 2 which may serve as ledges or supports for supporting bricks, shown in dotted outline, on both sides of the hanger 1. In some instances the toothed elements 2 may be pierced into the side of the structural elements for supporting them.

Figure 3:
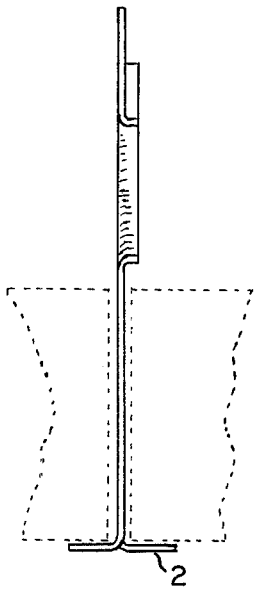

A top central partial hole 3 is provided which terminates in a downward and laterally extending slot which is bordered throughout by a flanged portion (best seen in FIG. 3) for reinforcing the hanger as well as to facilitate lateral sliding of the hanger onto the supporting rod (not shown). Therefore, the hanger, when loaded with bricks, may be easily and quickly hooked onto the rod separately or in selective numbers that can be easily handled by the bricklayer. Stated differently, instead of requiring the bricklayer to extend the supporting rod through a large number of hangers with bricks supported thereon and lifting the entire group of hangers and bricks which make up the entire arch or overhead structure, they may be lifted singly or in small numbers, until whatever number of bricks desired on the overhead structure have been accumulated.

It will be especially noted that the opening 3 has a sufficient circular portion to assure safety when supported on the rod and yet has a lateral portion to make it very easy to slip a hanger onto the rod or away from the rod when accumulating enough bricks for the entire overhead span.

A central hole 4 is also provided to enable insertion of an additional supporting rod after assembly of a group of hangers in side-by-side relationship.

While bricks have been indicated, other structural elements such as stone, blocks and plastic units may be used instead.

Thus it will be seen that I have provided a highly efficient and versatile hanger for selectively supporting a group of bricks and which may be easily supported on the conventional supporting rod singly, instead of in multiples of large numbers which otherwise causes an extremely heavy load involving an arduous task of lifting a large number of bricks at one time to the overhead position for mortaring a span or arch.

While I have illustrated and described a single specific embodiment of my invention, it will be understood that this is by way of illustration only and that various changes and modifications may be contemplated in my invention and within the scope of the following claims.

I claim:

1. A hanger for detachably supporting rows of bricks while making overhead spans and arches, comprising a unitary sheet metal piece having at the top, a cut-out portion in the form of a partial circle adjoining a lateral slot extending downwardly and outwardly to form a hook shaped top portion surrounded along its inner periphery and that of said slot with a flanged portion of said sheet metal piece, and a pair of downwardly and outwardly extending leg portions terminating, at their bottom ends only, in toothed ledge portions extending outwardly from both sides of the hanger at right angles thereto, and a central circular hole located below and immediately adjacent said lateral slot and above the level of the supported bricks and of sufficiently large diameter so as to receive a supporting rod for the bricks after they are hung in place whereby selective numbers of bricks may be hooked onto a lifting rod extending through said cut-out portion when lifted into place, followed by insertion of a permanent support rod through said central circular hole.

* * * * *